United States Patent [19]

Edward et al.

[11] Patent Number: 4,800,393

[45] Date of Patent: Jan. 24, 1989

[54] MICROSTRIP FED PRINTED DIPOLE WITH AN INTEGRAL BALUN AND 180 DEGREE PHASE SHIFT BIT

[75] Inventors: Brian J. Edward, Jamesville; Richard J. Lang, Liverpool; Daniel E. Rees, Camillus, all of N.Y.

[73] Assignee: General Electric Company, Syracuse, N.Y.

[21] Appl. No.: 80,955

[22] Filed: Aug. 3, 1987

[51] Int. Cl.[4] ..... H01Q 1/38; H01Q 9/16

[52] U.S. Cl. ..... 343/821; 343/822; 343/859; 333/26

[58] Field of Search ..... 343/700 MS File, 820-822, 343/795, 806, 807, 876, 859, 846, 848; 333/25, 26, 258, 262

[56] References Cited

U.S. PATENT DOCUMENTS 3,623,112 11/1971 Rupp ..... 343/821

FOREIGN PATENT DOCUMENTS 55150 5/1979 Japan ..... 333/26

*Primary Examiner*—William L. Sikes
*Assistant Examiner*—Michael C. Wimer
*Attorney, Agent, or Firm*—Richard V. Lang; Carl W. Baker; Fred Jacob

[57] ABSTRACT

An improved element for use in an electrically steered antenna array is disclosed comprising a dipole, an integral balun and a 180° phase shift bit. The arrangement utilizes printed circuit techniques throughout using an unbalanced microstrip for connection to electrical circuitry, a balun for transitioning from unbalanced microstrip to a balanced dipole antenna and includes a low loss 180° phase shift bit formed by the use of a branched feed network including two diodes whose conductive states determine the sense of antenna excitation, and produce the equivalent of a 180° phase shift bit.

7 Claims, 3 Drawing Sheets

MICROSTRIP FED PRINTED DIPOLE WITH AN INTEGRAL BALUN AND 180 DEGREE PHASE SHIFT BIT

BACKGROUND OF THE INVENTION

1. Field of the Invention

The invention relates to a printed dipole antenna useful as a radiating element in microwave and millimeter wave arrays, and more particularly to a printed antenna with an integral balun and 180° phase shift bit useful in arrays which are electronically steered, and/or operated in the monopulse mode.

2. Prior Art

The present invention represents an extension of the invention of B. J. Edward and D. E. Rees, U.S. patent application Ser. No. 935,030, filed Nov. 26, 1986, entitled A MICROSTRIP FED PRINTED DIPOLE WITH AN INTEGRAL BALUN.

Electronically scanned phased arrays employ multi-bit phase shifters to steer a beam over a desired angular range. In fully electronically steered arrays the beam may be repositioned electronically in both elevation and azimuth by altering the relative phases of the antenna's radiating elements. This requires each element to have a multi-bit phase shifter whose state may be selected independently from all others. The conventional 180° phase shift bit exhibits both design complications and a relatively high insertion loss.

An array may be electronically steered in one plane and mechanically steered in the other to drastically reduce the number of individual phase shifters. This usually produces a cost saving at the expense of steering flexibility but is a common compromise in modern Solid State radars. Since the beam azimuth position is a function of the mechanical rotation of a usually large and cumbersome array, such a mechanically steered radar has less flexibility than an electronically steered array in the azimuth search rate or target dwell times.

Reductions in cost, design simplifcations, or performance improvements in the means for achieving electronic steering tend to further facilitate the more wide spread application of electronic steering.

Radars have a need to invert the phase of all the elements on one-half of the array in the process of forming a difference beam to refine the accuracy of an angular reading. Customarily, the phase is inverted from a feed assembly. The present arrangement provides a design alternative for achieving difference beam formation, and does so without substantial added complexity.

SUMMARY OF THE INVENTION

Accordingly, it is an object of the invention to provide an improved element for use in an antenna array.

It is another object of the invention to provide an improved element for use in an electronically steered antenna array comprising a dipole, an integral balun, and a 180° phase shift bit.

It is still another object of the invention to provide an improved element for use in an antenna array which may be fabricated using printed circuit techniques.

It is an additional object of the invention to provide an improved element for use in an antenna array using printed circuit techniques and comprising a dipole, an integral balun and a 180° phase shift bit.

It is a further object of the invention to provide an improved element for use in an antenna array applicable to millimeter wave frequencies.

It is another object of the invention to provide a novel low loss element for use in an electronically steered array comprising a dipole, an integral balun and a 180° phase shift bit.

These and other objects of the invention are achieved in a novel combination comprising a microstrip fed dipole with an integral balun and 180° phase shit bit. The combination is fabricated by patterning a first and a second metallized layer disposed respectively on the under and upper surfaces of a dielectric substrate.

The unbalanced microstrip "feed" is branched to form a second and a third microstrip transmission line with ground planes formed from the first metallized layer and the strip conductors formed from the second metallized layer.

A pair of switches are provided, each connected respectively between the strip conductor and ground plane in the second and third microstrip transmission lines at a quarter wavelength electrical length from the branch. With the diode conducting, the strip conductor is connected to the ground plane preventing r.f. through transmission, and with the diode non-conducting, the strip conductor is not connected to the ground plane permitting unhindered r.f. transmission. Control means are further provided to insure that one and only one branch permits transmission, in accordance with the desired "control state".

The novel combination further comprises a dipole radiating element formed from the first metallized layer, and a transition or "balun" in which a continuation of the ground plane of the unbalanced transmission lines in bifurcated by a central slot into a first and a second ground plane, the paired ground planes forming a balanced transmission line.

The strip conductors of the second and third unbalanced transmission lines continue beyond the switches into the balun to form a three part "U" shaped strip conductor disposed over the bifurcated ground planes to continue an unbalanced and reversable transmitting path from one branch to the other branch. The first transition part extends from one diode switch to the dipole, the second extends across the slot, and the third extends back to the other diode switch.

The dipole radiating element is formed as a diverging extension of the first and second bifurcated ground planes, the inner portions of the dipole arms being strongly coupled to the second part of the transition and the outer portions providing efficient radiation.

Further in accordance with the invention, the electrical length of the sides of the "U" of the unbalanced transmission lines, measured from the slot crossover to the switches is approximately one-half wavelength so as to provide a low shunt r.f. impedance to unbalanced mode currents at the dipole load, and the electrical length of the balanced transmission line is approximately one-fourth wavelength so as to provide a high shunt r.f. impedance to balanced mode currents at the dipole load.

In accordance with a further aspect of the invention, switching is provided by four diodes and two additional transmission line segments. Two diodes are provided separated by a further transmission line segment of approximately one-fourth wavelength electrical length in each branch. The arrangement reduces the effect of diode and connection parasitics permitting higher frequency operation.

DESCRIPTION OF THE DRAWINGS

The inventive and distinctive features of the invention are set forth in the claims of the present application. The invention itself, however, together with further objects and advantages thereof may best be understood by reference to the following description and accompanying drawings, in which:

DESCRIPTION OF THE PREFERRED EMBODIMENT

Figure 1A:
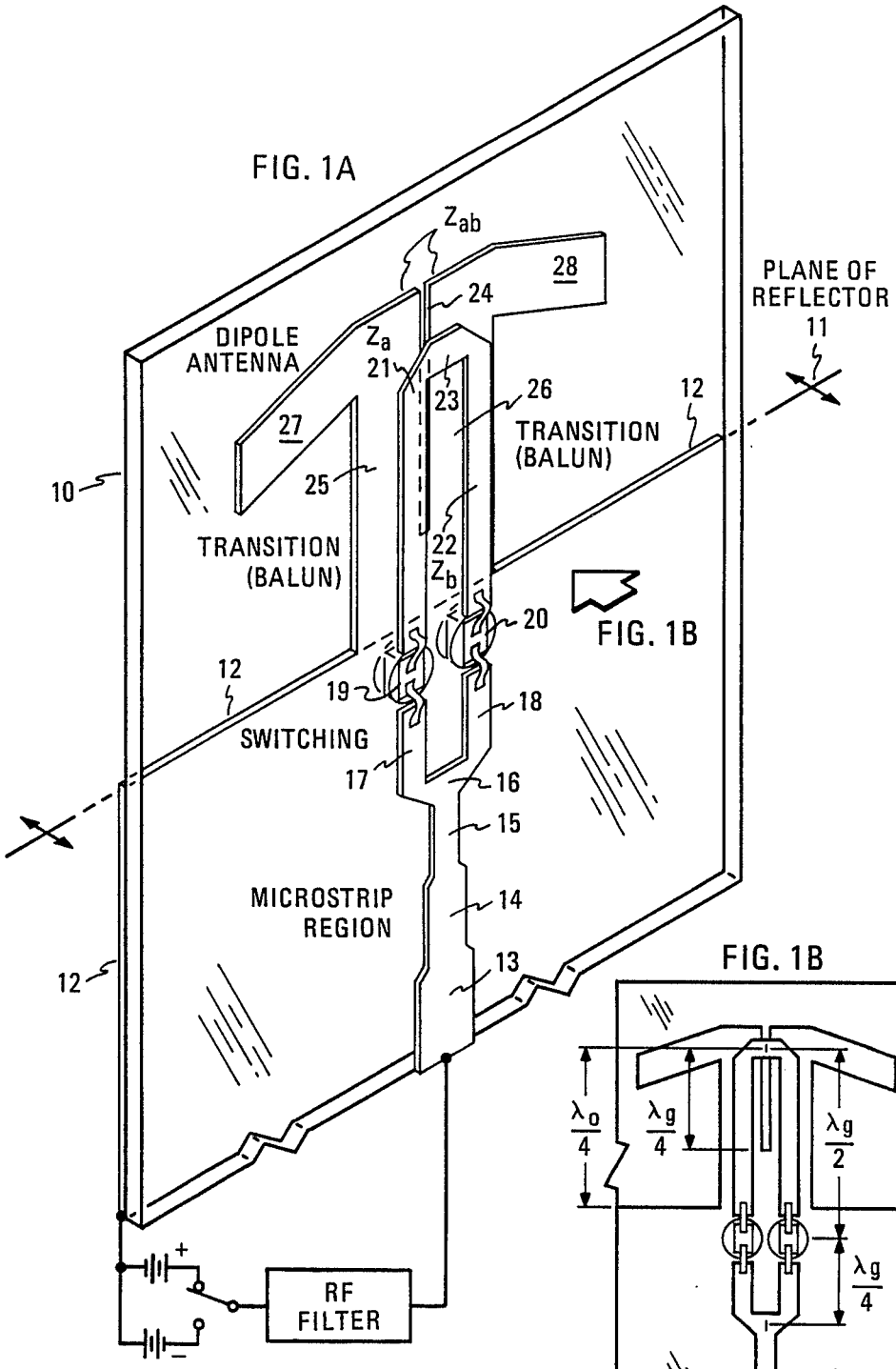
FIGS. 1A and 1B are illustrations of a microstrip fed printed dipole with an integral balun and 180° phase shift bit in accordance with a first embodiment of the invention, FIG. 1A being in perspective and FIG. 1B being a plan view illustrating the electrical dimensions.
Figure 1B:
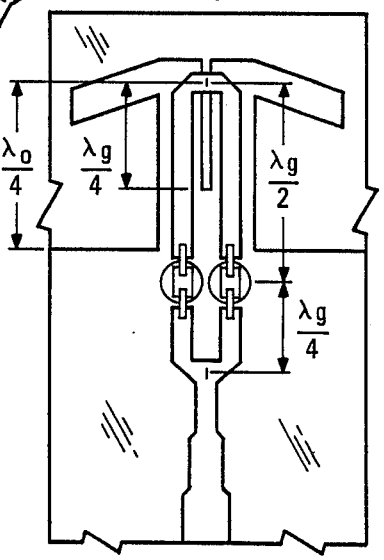

Referring now to FIGS. 1A and 1B, a microstrip fed printed dipole with an integral balun and 180° phase shift bit is shown. The arrangement consists of a planar dielectric substrate 10 supporting on its under surface a patterned first metallization, and on its uppersurface, a patterned second metallization. In a practical embodiment, the dielectric material is fused silica 0.64 millimeters thick and the metallizations are "printed" layers on the order of a hundredth of a millimeter (200 micro inches to 2/1000th of an inch depending on the process) in thickness.

For convenient discussion, the arrangement may be divided into four functional regions progressing from the transmitting/receiving circuitry (not shown) for feeding and being fed by the dipole antenna to the antenna. The first region contains an unbalanced microstrip transmission line to the circuitry and includes an impedance transformer. The second region contains a junction at which the transmission line is branched to form two parallel branches and contains two switches for activating a selected branch and inactivating the non-selected branch. The first two regions are arranged behind the plane of the reflector 11 for the dipole. The third region, in which the two branches emerge through the plane of the reflector in an inverted "U shaped" configuration, provides a transition from the unbalanced microstrip transmission line to the balanced radiating elements of the dipole antenna.

The microstrip transmission line in the first region provides a transmission path to the transmitting and/or receiving circuitry. An impedance transformer is included for providing an impedance match between the circuitry and the dipole antenna. The microstrip transmission line and impedance transformer are formed from an "infinite" width ground plane provided by the under surface metallization and strip conductor segments 13, 14, 15 of finite width patterned from the upper surface metallization and forming the unbalanced conductor.

The impedance transformer is formed from segment 13, 14, 15 and ground plane 12. Segment 13 and adjacent portions of ground plane 12 form the input to the impedance transformer. The input has the conventional 50 ohm characteristic impedance, a value selected for connection to the transmitting and/or receiving circuitry. Segment 14 and adjacent portions of ground plane 12 provide the impedance transformation. The transformer has a characteristic impedance of 63 ohms and is one-fourth wavelength in length. Segment 15 and adjacent portions of the ground plane 12 form the output from the impedance transformer. The output has a characteristic impedance of 80 ohms, a value selected to match the impedance at resonance of the dipole antenna.

The second region of the arrangement, at which the microstrip transmission line is branched and which contains two switches, is arranged to permit the transmission path to proceed in a clockwise or counter-clockwise direction into the inverted "U" shaped transition beyond the reflector 11. As will be explained, these switches permit one to effect a first state and a second state, the second state exhibiting a phase difference of 180° from the first state, and occasioning a 180° phase change in the antenna radiation.

The microstrip branch is disposed at the lower part of the second region and leads to the switches 19 and 20. The microstrip branch has a "T" shaped conductor supported over the ground plane 12. The stem of the "T" is formed from a continuation of the segment 15. The crosspiece (16) of the "T" is oriented in a plane orthogonal to the axis of the impedance transformer. The ends of the crosspiece are turned by means of a mitered corner to form two spaced, mutually parallel strip conductors 17 and 18 extending toward the switches 19 and 20. The extension of 17 and 18, namely 21 and 22, extend beyond the switches through the plane of reflector 11 and continue to the dipole arms. The crosspiece 16 is short being, dimensioned to place each strip conductor 17–21; 18–22 centrally over one of the bifurcated ground planes in the third or transition region (beyond the reflector 11).

The switches 19 and 20 are placed in the strip conductors a specified one-fourth wavelength electrical distance from the center of the branch. The states of the switches 19 and 20 determine whether the excitation to the antenna proceeds up the microstrip transmission path defined by strip conductor 17–21 and the adjacent portion of the underlying metallization forming a ground plane and returns via the microstrip transmission path defined by strip conductor 18–22, and adjacent portion of the underlying metallization forming the ground plane, or vice versa.

The switches 19 and 20 are each single diodes, connected between the underlying ground plane (metallization 12) and one of the two strip conductors 17, 18. The diodes are connected with mutually opposite polarities, the anode of one (e.g. 19) going to the ground plane, and the cathode of the other (e.g. 20) going to the ground plane. The upper diode connections to the strip conductors may be either wire bonds or ribbon bonds. Either mode of connection allows the diodes to reach mutually opposite states in which one diode is conducting and the other is non-conducting by application of a DC control voltage between the upper and lower metallizations, and allows the control states to be reversed by reversal of the polarity of a single DC control voltage.

Recapitulating, the first two functional regions of the arrangement, which have just been described, are disposed behind the reflector 11. The reflector 11 is placed one-quarter free space wavelength behind the dipole to give an optimum forward radiation pattern. The other two functional regions about to be described are disposed in front of the reflector. Finally the first metallization 12, which is formed on the under surface of the dielectric substrate 10, maintains a transverse dimension at least ten times the transverse dimension of the single and later double strip conductors 17, 18 and 21, 22 above it behind the reflector 11. However, when the first metallization emerges to the front of the reflector, the width is now reduced to three times the width of the double strip conductors. The characteristic impedances of the double microstrip lines remain at 80 ohms in the second region behind the reflector and this impedance is maintained as they emerge to the front of the reflector and continue through the third functional region.

The third functional region contains the transition between the microstrip transmission line and the dipole antenna, which occurs in front of the reflector 11. The ground plane of the microstrip, which emerges through the plane of the reflector 11 is bifurcated by a slot 24 to form two ground planes 25, 26 which together form a balanced transmission line coupled to the dipole. At the same time, the strip conductor 21 of the microstrip becomes one of three conductor segments (21, 22, 23) forming an inverted "U" shaped strip conductor to be further described, which is disposed over the members 25 and 26. The strip conductors 21, 22 and 23 arranged above the ground planes 25, 26 complete an unbalanced microstrip transmission line, which feeds and is fed by the dipole antenna.

The fourth functional region is the dipole radiating element or antenna which forms the balanced load of the microstrip transmission line. The dipole comprises two arms 27, 28, separated by a small gap and each extending transversely away from the gap for approximately one-fourth of a freespace wavelength. The inner portions of the dipole arms underlie the second part 23 of the "U" shaped strip conductor, and the outer portions of the dipole arms extend beyond the second part for efficient radiation. The dipole arms droop toward the reflective surface 11 to reduce coupling to adjacent dipoles, it being intended that the dipole will be used in a larger two dimensional array of like dipoles, with the reflective surface 11 providing optimum broadside energy radiation.

The third region of the arrangement, which will now be discussed in greater detail, provides the microwave transmission paths which efficiently couple the unbalanced microstrip to the balanced dipole antenna.

The transition within the third region commences approximately one-third of the distance from the reflector 11 to the dipole arms. This position is defined by the bottom of the slot 24 in the patterned first metallization. The slot divides the now narrowed first metallization into two equal width metallizations 25, 26 facilitating separation at the microstrip transmission lines under strip conductors 21 and 22 and permitting balanced operation of these metallizations in relation to each other. The strip conductor 21 is centered (laterally) over the metallization 25 and sufficiently displaced from metallization 26 as to be decoupled from it. The metallizations 25, 26 continue toward the dipole, mutually separated by the slot 24 as they finally merge into the arms of the dipole.

The balanced transmission line formed by metallizations 25 and 26 has a characteristic impedance of 80 ohms established by the width of the slot, the width of the metallizations 25, 26, and the thickness and dielectric constant of the supporting substrate. The electrical length of the balanced transmission line (the quantity theta ab) is measured from the base of the slot 24 to the half width of the dipole arm. The upper limit is close to the upper extremity of the inverted "U" shaped strip conductor and approximates the electrical position of the dipole load presented to the balanced line. The two balanced conductors 25, 26, which merge into the dipole arms, provide a balanced transmission line to the dipole arms 27, 28.

In the third region, the transition of energy in the dipole antenna and associated balanced line to and from the unbalanced microstrip transmission line takes place along the slotted portion of the ground plane and is most intense in the region near the base of the dipole arms. The sense of the excitation is governed by the state of the switches 19, 20 which establish whether the energy, for instance during transmission, enters via switch 19 and leaves via switch 20 or vice versa.

Granted, the former switching condition, the "U" shaped path followed by the unbalanced microstrip transmission line maintains an 80 ohm characteristic impedance throughout. The presence of the slot 24, which permits balanced operation of metallizations 25, 26, occurs without discontinuity in the propagation in the unbalanced microstrip along the path defined by the strip conductor segments 21 and 22. Segments 21 and 22 retain the same transverse dimensions as they proceed from the sites of the switches 19 and 20 up to the region of the dipole arms. The width of the underlying metallization drops at the plane of the reflector to approximately three times the transverse dimension of the double segments 21 and 22, which produces only a small discontinuity. The appearance of the slot 24 likewise occurs without causing a significant discontinuity in the unbalanced microstrip. Thus both microstrip paths continue to have an approximately 80 ohms characteristic impedance as they approach the segment 23 which crosses the slot 24.

The strip conductor segment 23 extends transversely from a point transversely centered over the left half ground plane 25 to a point transversely centered over the right half ground plane 26. At the corners where 21 and 23 join, and 23 and 22 join, a 45 degree cut in the metallization occurs producing a "mitered corner". The "mitered corner" is designed to facilitate the change in direction of the rf currents in the two portions of the strip conductor with minimum impedance change and therefore minimum reflection.

The transverse strip conductor segment 23 is disposed over the ground plane formed from the first metallization of adequate width to maintain unbalanced microstrip transmission and maintain the 80 ohm impedance of the microstrip without significant discontinuity. The metallizations underlying conductor 23 include portions of ground plane metallizations 25, 26 merging into the arms 27, 28 of the dipole. The underlying dipole metallizations extend a distance equal to the width of the strip conductor beyond the upper edge of the strip conductor; and the metallizations 25 and 26, which merge into the dipole arms 27 and 28, extend a distance equal to several strip widths below the lower edge of the strip conductor.

The arrangement as just described, will accordingly support both balanced transmission and unbalanced transmission in the region which transitions between the microstrip and the dipole. If the balanced line formed by the underlying metallization has an electrical length (theta ab) of one-fourth wavelength from the base of the slot to the point of maximum drive at the dipole, then the remote short circuit occasioned by the bottom of the slot will be transformed at the point of connection to the dipole to a high shunt impedance to balanced mode currents. The high shunt balanced mode impedance facilitates proper dipole excitation.

Similarly, if the portion of the unbalanced microstrip transmission line comprising strip conductor 23 and 22 (and the adjacent portions of the underlying metallizations forming the ground plane 26) ends in a short circuit due to conduction of the shunt connected switch 20 and if the electrical dimension (theta b) from the short circuited end of 22 to the point of slot cross over circuit of the microstrip 22 at the switch 20 will be transformed to a low shunt impedance to unbalanced mode currents (or substantial short circuit) at the point of dipole excitation. (The unbalanced mode impedance exists between the strip conductor 23 and the underlying metallizations forming the ground plane.) More explicitly, the short circuit produces a reflection from the short at the site of diode 20 and forms a standing wave whose current maximum occurs at the slot 24, and from which energy may be transferred (e.g. during transmission) to the antenna.

The standing wave thus established in the unbalanced microstrip transmission line provides an efficient means for energy exchange between the balanced line and balanced antenna on the one hand and the unbalanced line on the other hand. The use of the shunt switches which are either in a conductive or non-conductive condition are ideally free of loss. Ideally their presence permits the flow of energy through their point of connection without loss, when they are non-conductive. When they are conductive they redirect the flow of energy by creating reflections also without loss. Thus, when the reflections create standing waves, the issue of efficient design focuses on the proper placement of the diodes in relation to the "sources" and "loads" which are connected to the transmission lines.

The placement of the diodes 19 and 20 in relation to the load presented to the unbalanced line efficiently concentrates the transfer of energy to the region where the strip conductor crosses over the slot 24. The standing wave in the unbalanced line is distributed along the upper portion of the conductor 21, across the conductor 23, and the upper portion of the conductor 22. The current maximum or current anti-node is centered at the crossing of conductor 22 over the slot, and current nodes (minima) occur in the conductors 21 and 22 at positions one-fourth electrical wavelength away from that crossing. The degree of excitation produced by elements of the unbalanced line falls off as the distance from the current maximum increases, although some contribution by the strip conductors 21 and 22 may occur up to one-fourth wavelength from the center of the member 23. The balanced line is, however, less sensitive to drive as one approaches the base of the slot which defines the beginning of the balanced line. Thus from both the rf characteristics of the unbalanced drive, and the balanced load, the rf coupling is maximum in the region where the strip conductor 23 crosses over the slot 24.

Granted the foregoing rf wave distributions, and granted that the impedances are properly matched between the transmission line sources and the antenna load (e.g. 80 ohms) the transfer of energy approaches maximum efficiency and is reflection free.

The coupling from the driving circuitry via the impedance transformer 13, 14, 15 via the switches 19 and 20 to the transition is also efficient and substantially reflection free. As earlier noted, the switch 19 is positioned at the connection of strip conductor 17 to 21 one-fourth wavelength electrical length from the midpoint on segment 16 of the branch and the switch 20 is positioned at the connection of the strip conductor 18 to 22 one-fourth wavelength electrical length from the midpoint on segment 16 of the branch.

The foregoing dimensioning insures low loss and reflectionless switching in the path between the drive circuitry and the transition. Assuming, as we have, that switch diode 19 is non-conductive and switch diode 20 is conductive, energy supplied from the impedance transformer, appearing at strip conductor 15 will tend to divide evenly between the branches 17 and 18 if one assumes matched loading. That rf energy which enters the branch 17 "sees" a matched load and proceeds past the non-conductive diode without loss and without reflection, and enters the inverted "U" shaped strip line transition.

The r.f. energy which would enter the branch 18, however encounters a different fate since there is a mismatch. The rf energy which would enter branch 18 encounters the conductive diode presenting a short circuit, and would be reflected back toward the center of the branch. The path length from the diode to the center is however one-fourth wavelength, and the postulated energy returning to the center of the branch would be 180° out of phase with and would tend to cancel the incoming wave. The practical result is that the short circuit at the site of diode 20 is transformed to an open circuit at the branch and (ideally) no energy is coupled into the shorted length of the transmission line. In practice some energy may be reflected back to the transformer, but it is usually small and substantially all the energy, is directed into the branch 17.

The descriptions which have been provided, due to the symmetry of the arrangement, and due to the laws of reciprocity, are true for both control states and for both transmission and reception. That is to say that the same performance is achieved when diode 19 is non-conductive and diode 20 is conductive; as when diode 19 is conductive and diode 20 is non-conductive. The laws are also true for both transmission and reception.

In short, the arrangement as so far described provides efficient coupling between the remote circuitry coupled to the 50 ohm input of the transformer and the balanced dipole antenna.

The arrangement so far described includes the necessary microstrip impedance transformer, a "transition" or balun between the unbalanced microstrip and the balanced dipole antenna, the balanced antenna per se, and by virtue of the phase inversion in the drive circuitry effected by changing the control states of the diodes, the equivalent of an efficient 180° phase shift bit. All four of the above elements are cheaply and efficiently carried out into the printed circuit techniques associated with microstrip transmission lines and available from a stock substrate consisting of a central insulated core, and patterned conductive layers on the upper and lower surfaces thereof.

A mathematical analysis of the transitional section or balun of the first embodiment is suggested from the treatment of a coaxial balun in an artical by W. K. Roberts published in the proceedings of the IEEE December 1957 entitled "A New Wideband Balun", Vol. 45, pages 1628 to 1631.

Figure 2A:
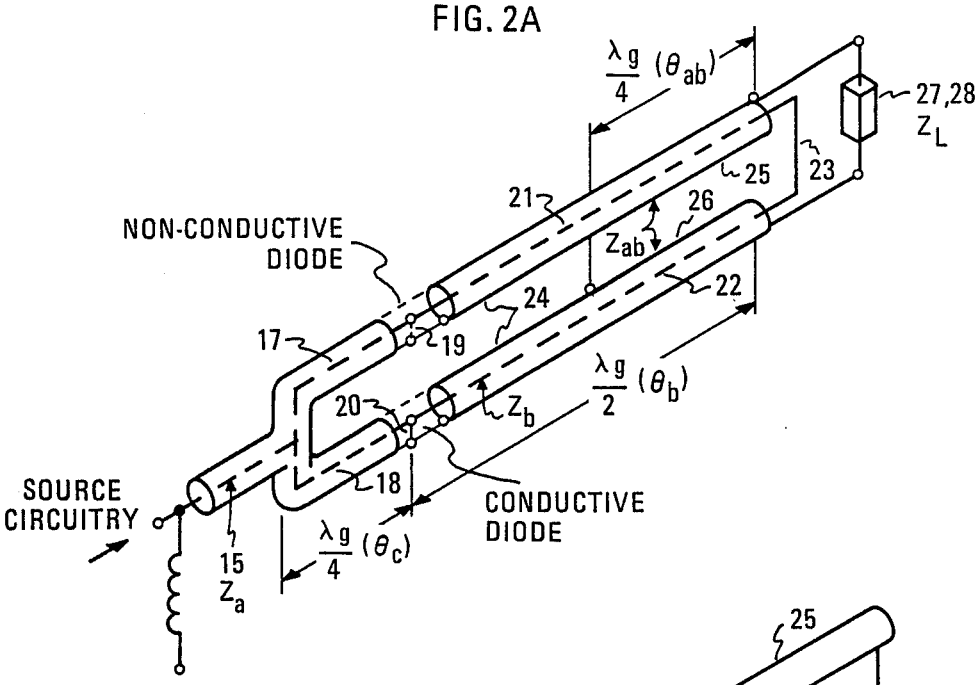
FIG. 2A is an illustration of a known coaxial balun structure.
Figure 2B:
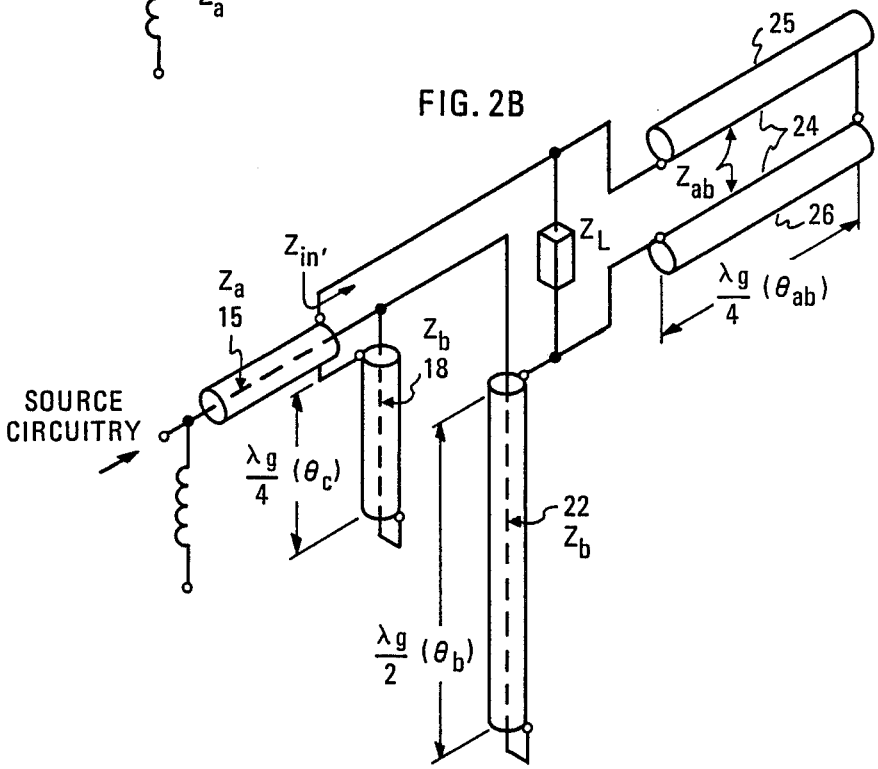
FIG. 2B is an equivalent circuit representation of the FIG. 2A coaxial balun structure.

FIG. 2A which uses a coaxial representation of the unbalanced and balanced transmission lines of the present arrangement, is a first redrawing of the balun as two branched coaxial lines. FIG. 2B, is a further redrawing of the FIG. 1A balun, which is more readily characterized mathematically.

The associated transmission line elements and their electrical parameters which enter into the mathematical description of the balun are as follows. The first coaxial line nearest the source circuitry in FIG. 2A represents the microstrip transmission line associated with conductor 15. The shell of the coaxial line corresponds to the ground plane of the microstrip and the central conductor of the coaxial line corresponds to the conductor 15 of the microstrip. This transmission line has the characteristic impedance Za. The coaxial line branches into an upper branch and a lower branch. The upper branch corresponds to the microstrip defined by conductors 17 and 21 and contains the non-conductive diode 19 shown as a dashed unshorted or through circuit. The lower branch corresponds to the microstrip defined by conductors 18 and 22 and contains the conductive diode 20 shown as a short circuit. The unshorted and shorted diode positions, as illustrated, are at one-fourth wavelength electrical length from the branch. The conductor connecting the central conductors together at the remote ends of the coaxial lines 21 and 22 corresponds to the microstrip conductor 23. The coaxial lines are both one-half wavelength electrical length (theta b=lambda g/2) measured between the diode positions and conductor 23. The coaxial shells form a balanced transmission line of impedance Zab, which is interconnected at a point corresponding to the base of the slot 24. The base of the slot is one-fourth wavelength electrical length (theta ab=lambda g/4) measured to the conductor 23. The load $Z_L$, which is connected between the two shells at the ends of the coaxial lines represents the dipole antenna.

In FIG. 2B the coaxial representation is further redrawn using circuit equivalents. The coaxial connection to the source circuitry remains as in FIG. 2A, but the through-line upper branch 17, 21 with the non-conductive diode 19 is removed from the representation. The lower branch 18, 22 with the conductive diode 20 is represented as a shorted quarter wavelength coaxial line stub (corresponding to 18) connected in shunt (i.e. central conductor to center conductor and shell to shell) with the input coaxial line (corresponding to 15). The shorted half wavelength coaxial line stub (corresponding to 22) has its central conductor connected to the central conductor of the input coaxial line. The coaxial shells of a quarter wavelength electrical length, shorted at one end now represent the resonant balanced line 25 and 26. The shells are connected respectively between the input line shell and the shell of the shorted half wavelength coaxial line stub corresponding to 22. The stub presents a low impedance between its central conductor and shell. The load $Z_L$ and the resonant balanced line (25, 26) thus connected in series with the shells of the input line and the half wavelength stub 22.

More concisely, the (unbalanced) coaxial transmission line corresponding to 18 forms an open circuited stub shunting the input coaxial line 15. The coaxial transmission line corresponding to 22 forms a short circuited stub serially connected with the load impedance, Z1. The shells of the coaxial transmission lines (25, 26) form an open circuited stub of characteristic impedance Zab connected in shunt with the load. From inspection, the circuit equivalently represented in FIG. 2B, provides an efficient path between the source and the load.

Mathematically the impedance $Z_{in}'$, of the balun structure maybe expressed as follows:

$$Z_{in}' = \frac{Z_b \tan\theta_c \left[ jZ_b \tan\theta_b + \dfrac{jZ_1 Z_{ab} \tan\theta_{ab}}{Z_1 + jZ_{ab}\tan\theta_{ab}} \right]}{Z_b \tan\theta_c + Z_b \tan\theta_b + \dfrac{Z_1 Z_{ab}\tan\theta_{ab}}{Z_1 + jZ_{ab}\tan\theta_{ab}}} \quad [1]$$

where theta b represents the electrical length of the short circuited series stub, theta ab represents the electrical length of the short circuited balanced line shunt stub, theta c represents the electrical length of the short circuited shunt stub at the input (and the other quantities are as defined in the preceeding text).

For the design conditions of theta ab equal to 90° (lambda g/4), theta b equal to 180° (lambda g/2), and theta c equal to 90° (lambda g/4), the impedance $Z_{in}'$ becomes equal to that of the dipole impedance, $$Z_{in}' = Z_1. \quad [2]$$

In the microstrip realization, the realizable spacing between the balanced line conductors limits the lower extreme of Zab while the three times microstrip ground plane width constraint, limits the lower extreme of Za and Zb and the upper extreme of Zab. The actual characteristic impedance selected for these transmission lines is influenced by the supporting substrate's dielectric constant and thickness with values between 60 and 100 ohms being typical.

The arrangement described in FIGS. 1A and 1B is of maximum simplicity in its use of a single pair of diodes. The first embodiment is useful from low frequencies up to about 10 GHz, depending upon the quality of diodes employed as shunt switches. Ideal performance is not achieved by this simpler arrangement at frequencies significantly above 10 GHz, which is in the region where diode parasitics cause degraded performance. The critical parasitics are the diode capacitance ($C_D$); resistance ($R_D$) and serial lead inductance ($L_S$). Wire bonds which are a practical mode of interconnection, may introduce additional lead inductance ($L_B$) between the diodes and the strip conductors, and may also cause degradation. The degradation at the higher frequencies is normally in respect to both transmission loss and reflections.

Figure 3:
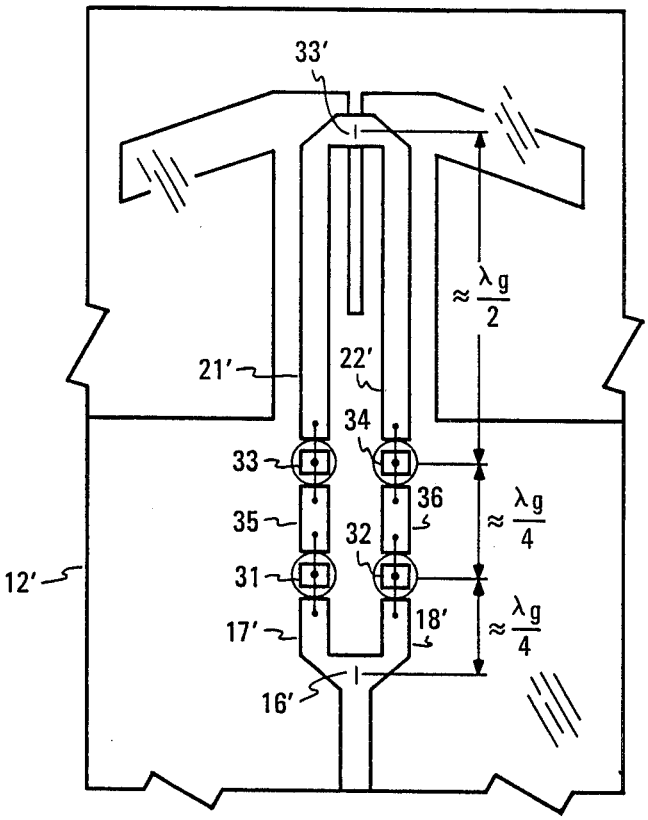
FIG. 3 is a plane view of a portion of a microstrip fed printed dipole with an integral balun and 180° phase shift bit modified for operation at millimeter wave frequencies in accordance with a second embodiment of the invention.
Figure 4:
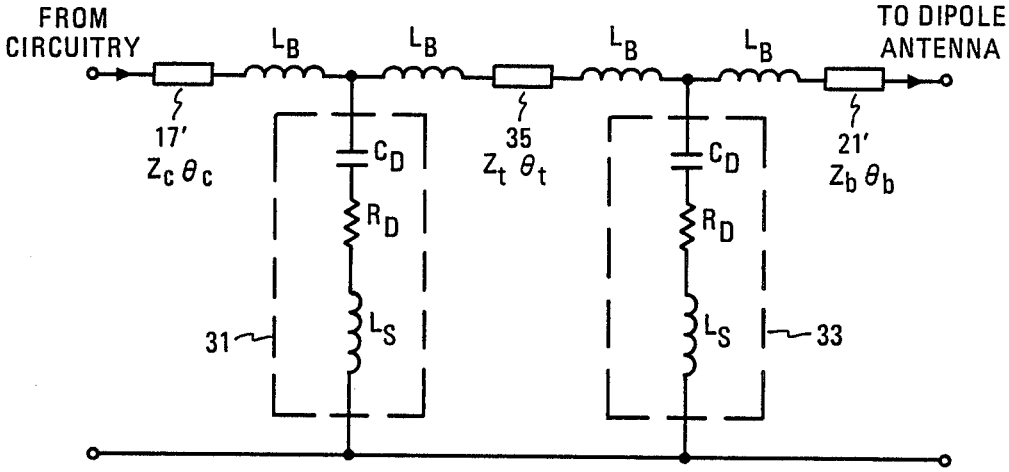
FIG. 4 is an equivalent circuit representation of the two diode switch bit employed in the second embodiment of the invention.

FIG. 3 shows a plan view of a portion of a second embodiment of the invention having a 180° phase bit refined for improved efficiency at 30 to 40 gHz, and FIG. 4 contains an equivalent circuit representation of the critical parasitics associated with the diode switch refined for higher frequency operation.

The second embodiment employs a dipole antenna and integral balun and an input impedance transformer of the type shown in FIG. 1A. FIG. 3, for simplicity, shows only that portion of the second embodiment commencing at the microstrip corresponding to element 15 in FIG. 1A, and continuing through the elements forming the switch refined for higher frequency operation, and concluding with a portion of the arrangment extending in front of the reflector 11 in FIG. 1A. For simplicity, elements from the first embodiment repeated in the second embodiment bear primed reference numerals. The 180° phase shift bit includes four diodes 31–34 and two additional microstrip transmission lines connected between the diodes 31 and 33 and between diodes 32 and 34.

As seen in FIG. 3, one of the microstrip transmission lines in the two diode switch is formed by a finite width conductor 35 patterned from the second metallization and a portion of the first metallization providing an infinite width ground plane. The other microstrip transmission line is similarly formed by a finite width conductor 36 patterned from the second metallization over a ground plane provided by the first metallization. The microstrip transmission line corresponding to conductor 35, has one end closely adjacent to the strip conductor 17' leading to the branch and the other end closely adjacent to the strip conductor 21' leading into the transition and dipole antenna. The microstrip transmission line corresponding to conductor 36 also has one end closely adjacent to the strip conductor 18' leading to the branch and the other end closely adjacent to the strip conductor 22' leading to the transition and dipole antenna.

The diodes 31–34 are installed in the gaps between the conductors 35 and 17'; 35 and 21'; 36 and 18'; and 36 and 22' and their connections preserve electrical continuity in the respective paths. More particularly the diodes 31 and 33, which are both PIN diodes designed for millimeter wave (e.g. 40 gHz) operation, have their anodes connected by solder to the first metallization on the undersurface of the substrate. The cathode of diode 31 is connected to conductor 17' and to conductor 35 by a (single or double) wire bond spanning the gap between 17' and 35. Similarly the cathode of diode 32 is connected to conductor 36 and to conductor 18' by a wire bond spanning the gap between 35 and 18'. The NIP diodes 32 and 34 are inverted in relation to the PIN diodes 31 and 33, and have their cathodes connected to the first metallization and their anodes connected to wire bonds bridging the gaps between conductors 18' and 36 and 36 and 22'. Thus electrical continuity through the diode connections is maintained by the wire bonds.

The equivalent circuit of one branch of the arrangement is illustrated in FIG. 4. The circuit depicts the path from 17' to 21' and consists of two "Y" filter sections each representing one diode and its wire bonds, the two filter sections being spaced between the three microstrip transmission lines (17', 35 and 21'). Suitable diodes are Alpha diode type CSB7002-05-150-801; the diodes employed exhibited a diode capacitance (Cd) of between 0.03 and 0.05 pico-farads, a diode resistance (Rd) of 3 ohms (at 1 ma), and a series inductance $L_S$of 0.012 nano-henries. The inductance of each lead $L_B$ was about 0.16 nano-henries corresponding to a lead length of about 0.010 inches placed in close proximity to a ground plane. The circuit was fabricated on a 0.010" thick alumina substrate.

In computer optimization of the values of S11, S12, S21 and S22 of the switching network, tailoring of the microstrip impedances and lengths were dictated. The diode pairs 31 and 33 and 32 and 34 were spaced one-fourth wavelength apart, the electrical length being made up partly by the wire bonds and partly by the added microstrip section. The impedance of the microstrip transmission line corresponding to conductor 15' was 72 ohms, that correspond to the branches 17' and 18' was 85 ohms, that corresponding to conductors 35 and 36 was 66 ohms, and that corresponding to 21' and 22' and 22' 101 ohms. These values provided a measured insertion loss of about 0.85 db from 30 to 38 GHz, a value supported by both calculation and measurement.

At lower frequencies (e.g. 5–6 gHz) where only a single diode pair is required and where somewhat better diode performance is available, the predicted loss is 0.5 db or below. Comparable phase shift networks, which require 180° phase bits frequently have losses on the order of 0.8 db for a 90° phase bit and 1.6 db for 180° phase bit. Thus in comparison to more conventional phase shift networks used on electronically steered arrays, the present arrangement provides a more efficient solution for achieving the necessary phase shifting capability.

The present invention provides a low loss 180° phase shift bit accompanying a microstrip fed dipole with an integral balun which is applicable to several kinds of radar systems operating over a wide frequency spectrum including both conventional lower frequencies and higher millimeter-wave frequencies.

The present element, which is readily manufactured using printed circuit techniques, provides an electrically efficient 180° phase shift bit, minimizing losses in arrays which are fully electronically steered. The element simplifies electronic steering, and provides an alternative means of achieving difference beams operation.

What is claimed is:

1. In combination, a microstrip fed printed dipole with an integral balun and 180° phase shift bit, fabricated by patterning a first and a second metallized layer disposed respectively on the under and upper surface of a planar dielectric substrate, said combination comprising:

(1) an unbalanced first microstrip transmission line including a first strip conductor and a first ground plane, said transmission line having a branch at which a second and a third microstrip transmission line are formed, the second transmission line including a second strip conductor and a second ground plane, and the third transmission line including a third strip conductor and a third ground plane with the three said ground planes being formed from said first metallized layer and the three said strip conductors being formed from said second metallized layer, (2) a pair of switches, the first switch connected between said second strip conductor and said second ground plane, and said second switch connected between said third strip conductor and said third ground plane, each switch being positioned at an electrical length approximately equal to one-fourth wavelength from said branch, each switch having a first state in which the strip conductor, to which it is connected, is connected to the ground plane, to which it is connected, and a second state in which the strip conductor, to which it is connected, is disconnected from the ground plane to which it is connected to respectively prevent and permit r.f. transmission in the transmission line, (3) control means coupled to said switches to achieve a first control state in which said first switch is conductive and said second switch is non-conductive or a second control state in which said first switch is non-conductive and said second switch is conductive, (4) a dipole radiating element formed from said first metallized layer, and (5) a transition in which a continuation of the ground plane of said unbalanced transmission lines is bifurcated by a central slot into a first and a second ground plane, said first and second ground planes of said transition forming a balanced transmission line, and continuations of the strip conductors of said second and third transmission lines form a three part "U" shaped strip conductor with the base of the "U" remote from said branch, said "U" shaped conductor continuing over said bifurcated ground planes to provide propagation between said three parts and said bifurcated ground planes, propagation proceeding in one consecutive order or the reverse consecutive order, depending upon which of said two control states is present, a first of said three parts, which forms a portion of said second transmission line, being disposed between said branch and said dipole, a second of said three parts, which forms a crossover extending across said slot over said dipole from one bifurcated ground plane to the other bifurcated ground plane, and the third of said three parts, which forms a portion of said third transmission line, being disposed between said branch and said dipole, said dipole radiating element being formed as a diverging extension of said first and second bifurcated ground planes, the inner portions of the arms of said dipole underlying and being strongly coupled to said second part, and the outer portions of said arms extending beyond said second part for efficient radiation.

2. The combination set forth in claim 1 wherein the characteristic impedance of said balanced line is approximately equal to the dipole impedance at resonance, and the characteristic impedance of said second and third unbalanced lines is approximately equal to the dipole impedance at resonance.

3. The combination set forth in claim 2 wherein one of said switches is a diode having the anode thereof connected to said first metallized layer and the cathode thereof connected to said second metallized layer, and the other of said switches is a diode having the cathode thereof connected to said first metallized layer and the anode thereof connected to said second metallized layer.

4. The combination set forth in claim 3 wherein said control means is coupled between said first and said second metallized layers for establishing a DC potential of selective polarity for facilitating conduction in one or the other of said diodes, but not both for establishing a first and a second control state.

5. The combination set forth in claim 2 wherein one of said switches consists of a first diode, a fourth microstrip transmission line formed from said first and second metallized layers having an electrical length of approximately one-fourth wavelength, and a second diode, said first and second diodes having the anodes thereof connected to said first metallized layer and the cathodes thereof connected to said second metallized layer, and the other switch consists of a third diode, a fifth microstrip transmission line formed from said first and second metallized layers having an electrical length of approximately one-fourth wavelength, and a fourth diode, said third and fourth diodes having the cathodes thereof connected to said first metallized layer and the anodes thereof connected to said second metallized layer.

6. The combination set forth in claim 5 wherein, the impedance of said fourth and fifth transmission lines are equal and are selected to maximize switch transmission and minimize reflection respectively when the diodes of a switch are non-conductive, and to minimize switch transmission when the diodes of a switch are conductive.

7. The combination set forth in claim 1 wherein the electrical lengths of said first and third parts of said second and third unbalanced transmission lines respectively, measured from the switch to which it is connected to said slot crossover is approximately one-half wavelength so as to provide a low shunt RF impedance to unbalanced mode currents at the dipole load, and the electrical length of said balanced transmission line is approximately one-fourth wavelength so as to provide a high shunt RF impedance to balanced mode currents at the dipole load.

* * * * *